US010381757B2

(12) United States Patent
Geske et al.

(10) Patent No.: US 10,381,757 B2
(45) Date of Patent: Aug. 13, 2019

(54) BASE STRIP FOR CONNECTION TO AT LEAST ONE PLUG CONNECTOR PART

(71) Applicant: Phoenix Contact GmbH & Co. KG, Blomberg (DE)

(72) Inventors: Ralf Geske, Schieder-Schwalenberg (DE); Senta Pietschmann, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 7 days.

(21) Appl. No.: 15/743,684

(22) PCT Filed: Jun. 21, 2016

(86) PCT No.: PCT/EP2016/064260

§ 371 (c)(1),
(2) Date: Jan. 11, 2018

(87) PCT Pub. No.: WO2017/009008

PCT Pub. Date: Jan. 19, 2017

(65) Prior Publication Data

US 2018/0205162 A1 Jul. 19, 2018

(30) Foreign Application Priority Data

Jul. 16, 2015 (DE) ..... 10 2015 111 543

(51) Int. Cl.
*H01R 12/58* (2011.01)
*H01R 12/72* (2011.01)
(Continued)

(52) U.S. Cl.
CPC ..... *H01R 12/58* (2013.01); *H01R 9/16* (2013.01); *H01R 12/724* (2013.01); *H01R 13/41* (2013.01);
(Continued)

(58) Field of Classification Search
CPC ..... H01R 12/58; H01R 9/16; H01R 12/724; H01R 13/41; H01R 13/422;
(Continued)

(56) References Cited

U.S. PATENT DOCUMENTS 3,564,478 A * 2/1971 Hampton ..... H01R 24/52 439/581
4,431,253 A * 2/1984 Hochgesang ..... H01R 24/52 439/63
(Continued)

FOREIGN PATENT DOCUMENTS

CN 204230478 U 3/2015
DE 202007005387 U1 6/2007
(Continued)

*Primary Examiner* — Travis S Chambers
(74) *Attorney, Agent, or Firm* — Leydig, Voit & Mayer, Ltd.

(57) ABSTRACT

A base strip for connection to at least one plug connector part includes a housing which has a wall portion and at least one plug-in location, into which the at least one plug connector part can be inserted; at least one contact element arranged on the wall portion of the housing for electrically contacting to the plug connector part; and at least one dome which is arranged on the wall portion, protrudes from the wall portion, and has an opening through which the at least one contact element extends in an insertion direction and in which the contact element is held. The dome has two portions which are spaced apart from one another transversely to the insertion direction and are separated from one another by a slot.

9 Claims, 3 Drawing Sheets

(51) Int. Cl.

| | |
|---|---|
| ***H01R 13/41*** | (2006.01) |
| ***H01R 13/422*** | (2006.01) |
| ***H01R 24/60*** | (2011.01) |
| ***H01R 9/16*** | (2006.01) |
| ***H01R 13/627*** | (2006.01) |
| *H01R 13/64* | (2006.01) |
| *H01R 43/18* | (2006.01) |

(52) U.S. Cl.
CPC ..... *H01R 13/422* (2013.01); *H01R 13/6271* (2013.01); *H01R 24/60* (2013.01); *H01R 13/64* (2013.01); *H01R 43/18* (2013.01)

(58) Field of Classification Search
CPC .... H01R 13/6271; H01R 24/60; H01R 23/02; H01R 24/38; H01R 9/00; H01R 9/052
USPC ..... 439/676, 620.03, 675, 660, 733.1, 752.5
See application file for complete search history.

(56) References Cited

U.S. PATENT DOCUMENTS 5,653,601 A * 8/1997 Martucci ..... H01R 4/028 439/82
6,077,087 A * 6/2000 Endres ..... H01R 24/50 439/63
6,717,425 B2 * 4/2004 McClure ..... G01R 31/2818 324/755.01
9,819,106 B2 * 11/2017 Froebing ..... H01R 12/727

FOREIGN PATENT DOCUMENTS

DE 102010030958 A1 1/2012
DE 102013109806 A1 3/2015

* cited by examiner

BASE STRIP FOR CONNECTION TO AT LEAST ONE PLUG CONNECTOR PART

CROSS-REFERENCE TO PRIOR APPLICATIONS

This application is a U.S. National Phase application under 35 U.S.C. § 371 of International Application No. PCT/EP2016/064260, filed on Jun. 21, 2016, and claims benefit to German Patent Application No. DE 10 2015 111 543.3, filed on Jul. 16, 2015. The International Application was published in German on Jan. 19, 2017 as WO 2017/009008 under PCT Article 21(2).

FIELD

The invention relates to a base strip for connection to at least one plug connector part, the base strip having a housing and at least one contact element.

BACKGROUND

A base strip of this type comprises a housing which has a wall portion and forms at least one plug-in location into which the at least one plug connector part can be inserted. Arranged on the wall portion of the housing is at least one contact element for electrically contacting to the plug connector part. The base strip can be arranged, for example, on a circuit board in order to allow one or more plug connector parts to be connected to the circuit board. In this case, the at least one contact element can be brought into engagement in an electrically contacting manner with the plug connector part, and is also electrically connected to the circuit board, for example to a strip conductor of the circuit board, so that the plug connector part can be electrically connected to the circuit board by the contact element.

In order to arrange the at least one contact element on the wall portion in a mechanically fixed manner, a dome is provided on the wall portion, which dome protrudes from the wall portion and has an opening through which the at least one contact element extends in an insertion direction. The contact element is held mechanically in the opening, so that the plug connector part can be fixed to the contact element in order to establish an electrical contact.

Base strips of this type are usually produced as plastics moldings by means of plastics injection molding. In plastics injection molding, a plastics material is introduced into an injection mold and flows into the mold in a flow direction which corresponds, for example, to the longitudinal extension direction of the base strip. The mold is a negative mold for the base strip and, after the plastics material has cured, the formed workpiece can be removed from the mold (known as "demolding") to obtain the base strip.

If the base strip is formed in this manner, plastics material flows into correspondingly formed portions of the mold during injection molding to form a dome. Since these portions of the mold are filled successively, a weld line can arise on the dome which, after the plastics material has cured, can possibly have a reduced strength compared to other portions of the dome. A weld line of this type can thus result in a breaking point at which a crack can occur on the dome when it is under load, which can lead to a reduced strength in the retention of the contact element on the base strip. If the contact element is not held firmly on the associated wall portion of the base strip, it can complicate the mounting of the base strip on, for example, a circuit board and furthermore, can impair the fixing of a plug connector part to the contact element.

SUMMARY

In an embodiment, the present invention provides a base strip for connection to at least one plug connector part, comprising: a housing which has a wall portion and at least one plug-in location, into which the at least one plug connector part is configured to be inserted; at least one contact element arranged on the wall portion of the housing configured for electrically contacting to the plug connector part; and at least one dome which is arranged on the wall portion, protrudes from the wall portion, and has an opening through which the at least one contact element extends in an insertion direction and in which the contact element is held, wherein the dome has two portions which are spaced apart from one another transversely to the insertion direction and are separated from one another by a slot.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
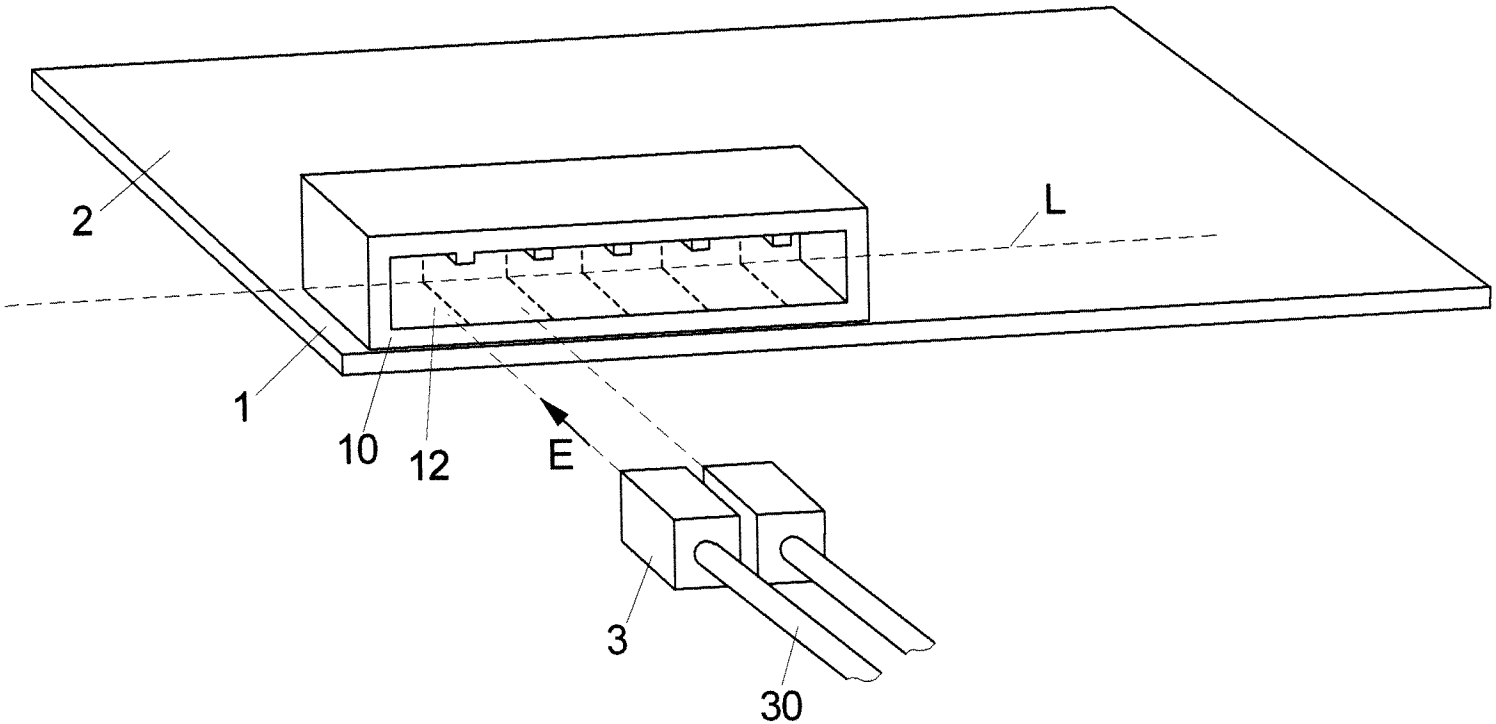
FIG. 1 is a schematic view of a base strip on a circuit board.
Figure 2:
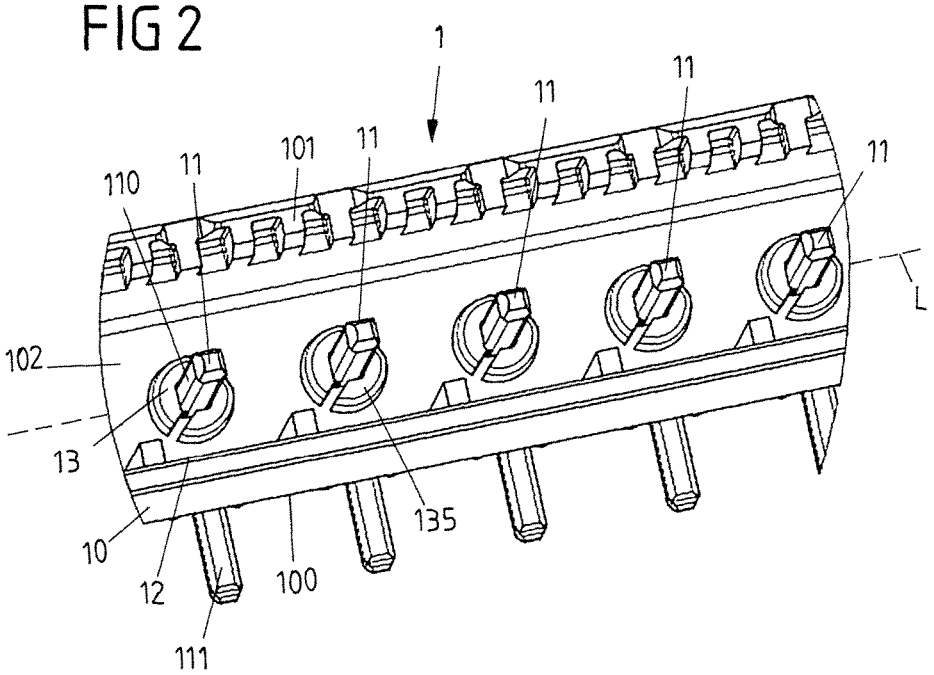
FIG. 2 is an enlarged view of a detail of an embodiment of a base strip.
Figure 3:
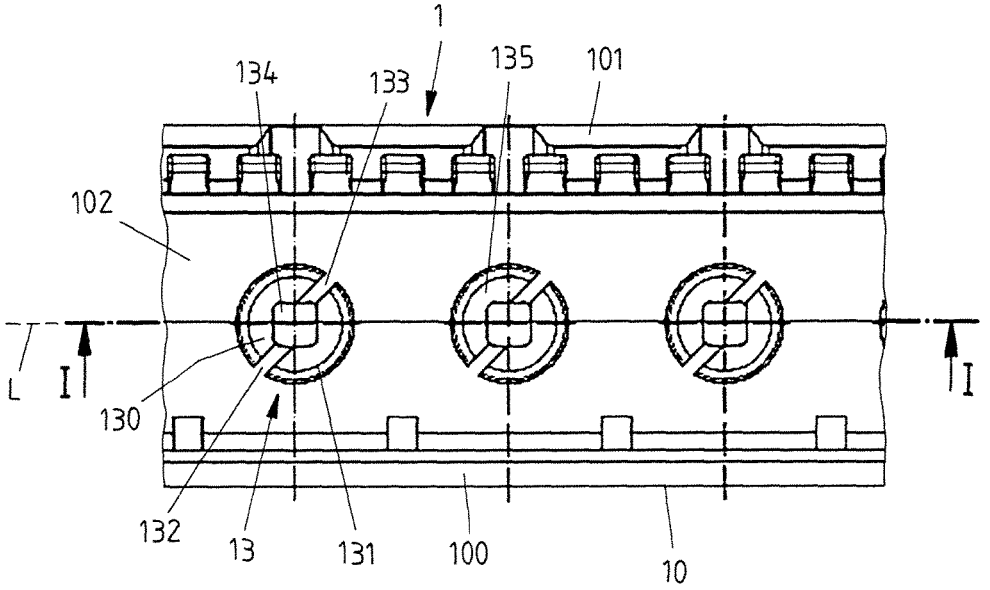
FIG. 3 is a plan view of the base strip according to FIG. 2.
Figure 4:
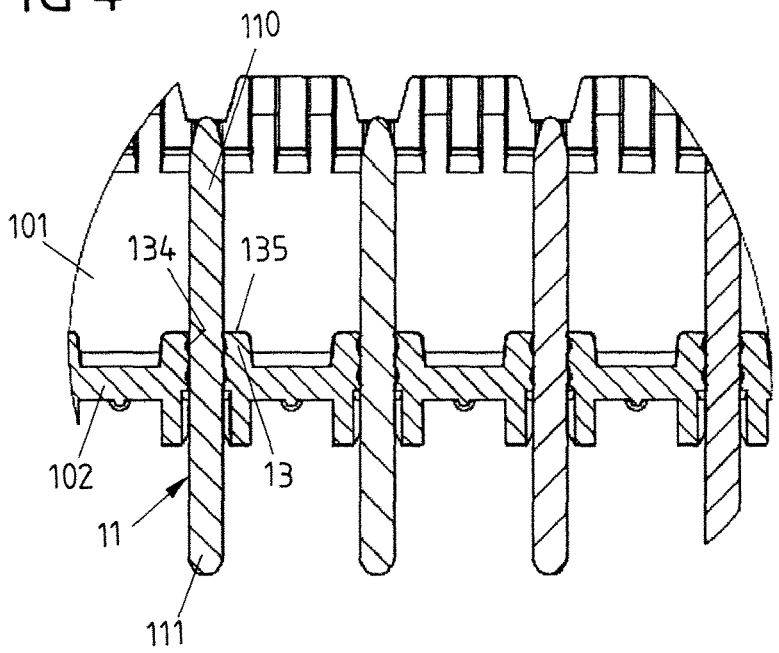
FIG. 4 is a sectional view along line I-I according to FIG. 3.

According to an embodiment, the dome has two portions which are spaced apart from one another transversely to the insertion direction and are separated from one another by a slot.

In an advantageous embodiment, the portions are diametrically opposed and form the opening between them. In this case, the dome can be cylindrical, for example, the slot dividing the dome into two semi-cylindrical portions, between which the opening is arranged, so that the semi-cylindrical portions enclose the opening between them and delimit it on both sides.

The present invention proceeds from the concept of dividing the dome into a plurality of portions. The opening is thereby no longer surrounded by the dome in a peripherally closed manner, but is delimited by, for example, two portions of the dome which are arranged on both sides of the opening and thus form the opening between them. Dividing the dome into a plurality of portions can prevent the occurrence of weld lines during plastics injection molding, in that the slot is arranged, for example, so that plastics material is prevented from converging from different directions during injection molding.

In this connection, it should be noted that, in principle, there may also be more than two portions. For example, the dome can also be divided into three, four, five or more portions which are separated from one another in pairs by slots. When viewed in the peripheral direction around the opening, the dome is thus divided into a plurality of portions so that the opening is not surrounded by the dome in a peripherally closed manner.

The base strip is advantageously produced from plastics material by plastics injection molding.

The slot is advantageously formed in the dome in the insertion direction, from an upper side of the dome remote from the wall portion, and extends between the portions, transversely to the insertion direction. The slot thus extends between the portions along a plane spanned by the insertion direction and by a transverse direction oriented transversely to the insertion direction, and is formed in the dome as a trough starting from the upper side of the dome so that the portions are separated from one another by the slot.

The base strip preferably extends along a longitudinal axis and has a plurality of plug-in locations which are mutually offset along the longitudinal axis. For example, the base strip can form four, eight or sixteen plug-in locations, into which individual plug connector parts in the form of connectors can be inserted. In this case, a plug connector part can be associated with one plug-in location, it also being conceivable and possible to insert a plug connector part into a plurality of plug-in locations in order to contact a plurality of contact elements.

In the plastics injection molding process, it is possible to allow the plastics material to flow into a mold in a flow direction oriented along the longitudinal axis. The material is thus injected into the mold along the longitudinal axis, so that the negative mold of the molding tool is filled successively to form the base strip. After the plastics material has cured, the molding thus obtained can then be removed from the mold to obtain the base strip.

In this case, the slot separating the portions of the dome preferably extends along an inclined axis that extends transversely to the insertion direction. The inclined axis preferably forms an acute angle, for example an angle of between 30° and 60°, for example 45°, to the longitudinal axis. The slot thus extends obliquely to the longitudinal axis, which can provide the advantage that, during plastics injection molding, weld lines do not arise on the portions of the dome and thus locations of reduced undefined strength are not produced on the portions of the dome.

The slot preferably has two slot portions which extend from the opening in the dome in opposite directions along the inclined axis. From the central opening in the dome, a first slot portion thus extends in a first direction and a second support portion extends in an opposite second direction, so that the dome is divided into two semi-cylindrical portions, for example.

In this case, these slot portions are not necessarily mutually aligned. Instead, it is possible, in an advantageous embodiment, for the slot portions to be mutually offset transversely to the inclined axis and transversely to the insertion direction. This can provide the advantage that a favorable shaped zone for holding the contact element in the opening of the dome is created inside the opening, the contact element advantageously resting on the insides of the portions of the dome.

The insertion direction, in which the dome protrudes from the wall portion of the housing of the base strip, can correspond, for example, to the direction in which a plug connector part can be inserted into a plug-in location of the base strip. In this case, the wall portion of the housing is, for example, the bottom of the base strip, it being possible for the base strip to have, for example, a substantially U-shaped form in cross section transversely to the longitudinal axis, having a bottom and side walls extending laterally at the bottom and forming limbs of the U, and between which the plug-in locations of the base strip are formed.

A base strip of this type can be designed for use on a circuit board, for example. For this purpose, the base strip can be connected to a circuit board, for example, by connecting contact elements of the base strip to corresponding contact points of the circuit board in order to thus bring the contact elements of the base strip into electrical contact with strip conductors of the circuit board.

The base strip can also be used on a (modular) electronic device. An electronic device of this type can be fitted, for example, in modular form to a mounting rail in order to take over control functions, for example, in an industrial plant together with other electronic devices.

An electronic device advantageously has a circuit board and a base strip, according to the previously described type, connected to the circuit board.

FIG. 1 is a schematic view of a circuit board 2 on which a base strip 1 is arranged. The base strip 1 extends along a longitudinal axis L and has a housing 10 which allows a plurality of plug-in locations 12 for the insertion of plug connector parts 3 in the form of connectors.

The circuit board 2 can be produced in a manner known per se from an electrically insulating material, for example, and can have a pattern of strip conductors on one side or on both sides. Electric and/or electronic components can be arranged on the circuit board, which components are interconnected by strip conductors to form electrical circuits.

The base strip 1 has a plurality of contact elements which are associated with the plug-in locations 12. By inserting a plug connector part 3 into a plug-in location 12 in an insertion direction E, the plug connector part 3 is electrically contacted with the contact element associated with this plug-in location 12, and an electrical line 30 connected to the plug connector part 3 is thereby connected to the circuit board 2. The contact element is electrically connected, for example, to an associated contact point of the circuit board 2, so that the plug connector part 3 is brought into contact with the circuit board 2 via the contact element.

FIGS. 2 to 6 show a specific embodiment of a base strip 1. The base strip 1 is produced, for example, as a plastics molding by means of plastics injection molding, and has two lateral wall portions 100, 101 which extend in parallel with one another along the longitudinal axis L and are interconnected by a further wall portion 102 which forms the bottom of the base strip 1. Plug-in locations 12 which are mutually offset along the longitudinal axis L are formed between the lateral wall portions 100, 101, it being possible for these plug-in locations 12 to be specified by suitable codings in the form of projections or the like, such that a plug connector part 3 can be inserted into a plug-in location 12 only in a predetermined orientation and in a predetermined position.

Associated with each plug-in location 12 is a contact element 11 which projects by a first contact portion 110 into the region of the plug-in location 12, and can be brought into contact with a contact point of a circuit board 2 by a second contact portion 111 which is bent at a right angle to the first contact portion 110. As shown in particular by FIG. 4, the contact element 11 passes through the bottom wall portion 102 of the housing 10 of the base strip 1 by its first contact portion 110 and lies in an opening 134 which extends through the wall portion 102 and a dome 13 protruding inwards from the wall portion 102. The contact portion 110 is shaped inside the opening 134 together with the dome 13 (and with the bottom wall portion 102), so that the contact element 11 is held mechanically on the wall portion 102.

The dome 13 of a plug-in location 12 protrudes inwards in the insertion direction E from the bottom wall portion 102 and surrounds the opening 134, through which the contact portion 110 the contact element 11 extends. The dome 13 serves to arrange the contact element 11 in a mechanically stable manner on the wall portion 102 in order to position the contact element 11 in a secure and fixed manner for the attachment of the base strip 1 on a circuit board 2 and for the subsequent insertion of a plug connector part 3.

In an advantageous embodiment, the base strip 1 is produced as a plastics injection-molded part by means of plastics injection molding. For this purpose, a suitable plastics material is injected into a molding tool which forms a negative mold, so that the plastics material flows into the negative mold, predetermined by the tool, in a flow direction F (shown in FIG. 5). By successively filling the negative mold, a molding is formed which, after the plastics material has cured and after the molding has been removed from the mold, forms the base strip.

Figure 6:
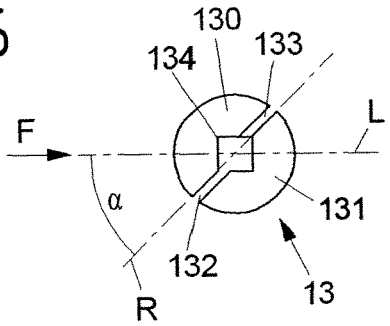
FIG. 6 is a schematic view of a dome on a wall portion of the base strip.

In the embodiment shown of the base strip 1, the dome 13 is divided into two portions 130, 131, in that a slot formed by two slot portions 132, 133 extends through the dome 13 along an inclined axis R (see FIG. 6). The dome 13, which is substantially cylindrical in its basic form, is thus divided into two substantially semi-cylindrical portions 130, 131 which are diametrically opposed relative to the opening 134 and enclose the opening 134 between them.

The slot portions 132, 133 extend through the entire dome 13 in the insertion direction E, from an upper side 135 of the dome 13 as far as the bottom wall portion 102, so that the slot portions 132, 133 divide the dome 13 into two halves. The dome 13 is thus not closed peripherally, but is opened by the slot portions 132, 133.

As shown by the schematic view in FIG. 6, the inclined axis R extends at an acute angle $\alpha$ to the longitudinal axis L. This angle $\alpha$ can have a value of, for example, between 30° and 60°, for example 45°.

Figure 5:
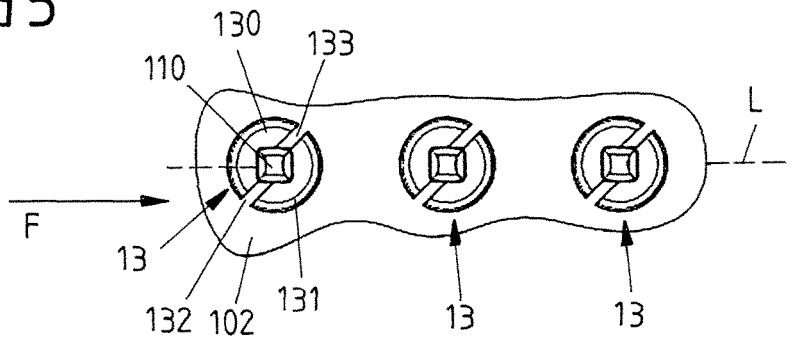
FIG. 5 shows a detail of the view according to FIG. 3, showing a flow direction during the plastics injection molding of the base strip.

In the embodiment shown, the flow direction F in the plastics injection molding process is oriented along the longitudinal axis L, as shown schematically in FIGS. 5 and 6. Since the slot formed by the slot portions 132, 133 is oriented obliquely to the longitudinal axis L and thereby also obliquely to the flow direction F, during plastics injection molding, weld lines are prevented from being able to form on the dome 13, in particular on the portions 130, 131 of the dome 13. This is achieved in that the dome 13 does not completely surround the opening 134 such that it is closed, but instead the dome is divided by the slot 132, 133 into two mutually separate portions 130, 131. Thus, during the filling of the negative mold of the injection molding tool, no weld lines are formed, and therefore locations of reduced strength are not produced on the portions 130, 131.

As can be seen in the schematic view according to FIG. 6, the slot portions 132, 133 are mutually offset, transversely to the inclined axis R (and transversely to the insertion direction E), so that, when viewed along the inclined axis R, they do not align with one another. This asymmetrical, non-aligning arrangement of the slot portions 132, 133 means that an advantageous shaped region is produced inside the opening 134 for favorable retention of the contact portion 110 of the contact element 11 in the opening 134.

The fundamental concept of the invention is not restricted to the previously described embodiments, but can also be realized in principle for entirely different embodiments.

A base strip of the type described here can advantageously be used together with a circuit board. However, it is also conceivable and possible to use the base strip on an electronic device, with or without a circuit board.

In the embodiment shown, the dome is divided into precisely two portions. However, it is also conceivable and possible to divide the dome into a plurality of portions, for example into three, four, five or even more portions.

In the embodiment shown, the base strip has a plurality of plug-in locations. In principle, however, the base strip can also form only one plug-in location.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Base strip
10 Housing
100-102 Wall portion
11 Contact element
110, 111 Contact portion
12 Plug-in location
13 Dome
130, 131 Portion
132, 133 Slot portions
134 Opening
135 Upper side
2 Circuit board
3 Plug connector part
30 Line
$\alpha$ Angle
E Insertion direction
F Flow direction
L Longitudinal axis
R Inclined axis

The invention claimed is:

1. A base strip for connection to at least one plug connector part, comprising:

a housing which has a wall portion and at least one plug-in location, into which the at least one plug connector part is configured to be inserted;

at least one contact element arranged on the wall portion of the housing configured for electrically contacting to the plug connector part; and at least one dome which is arranged on the wall portion, protrudes from the wall portion, and has an opening through which the at least one contact element extends in an insertion direction and in which the contact element is held, wherein the dome has two portions which are spaced apart from one another transversely to the insertion direction and are separated from one another by a slot, wherein the base strip extends along a longitudinal axis, and a plurality of plug-in locations are mutually offset along the longitudinal axis, wherein the slot extends along an inclined axis, extending transversely to the insertion direction, at an acute angle of between 30° and 60° to the longitudinal axis.

2. The base strip according to claim 1, wherein the dome portions are diametrically opposed and form the opening between them.

3. The base strip according to claim 1, wherein the dome is cylindrical and the dome portions are semi-cylindrical.

4. The base strip according to claim 1, wherein the slot is formed in the dome in the insertion direction, from an upper side of the dome remote from the wall portion, and extends between the dome portions transversely to the insertion direction.

5. The base strip according to claim 1, wherein the slot has two slot portions which extend from the opening in the dome in opposite directions along the inclined axis.

6. The base strip according to claim 5, wherein the slot portions are mutually offset transversely to the inclined axis and transversely to the insertion direction.

7. The base strip according to claim 1, wherein the plug connector part is insertable into the at least one plug-in location in the insertion direction, the at least one dome protruding from the wall portion of the housing in the insertion direction.

8. The base strip according to claim 1, wherein the base strip is configured to be arranged on a circuit board.

9. An electronic device comprising:

a circuit board; and the base strip according to claim 1 connected to the circuit board.

* * * * *